US006861388B2

(12) United States Patent
Ishibashi et al.

(10) Patent No.: US 6,861,388 B2
(45) Date of Patent: Mar. 1, 2005

(54) ANTIFALSIFICATION RECORDING PAPER AND PAPER SUPPORT THEREFOR

(75) Inventors: Yoshimi Ishibashi, Amagasaki (JP); Masanori Ohhashi, Amagaski (JP); Hiroshi Ito, Tokyo-to (JP)

(73) Assignee: OJI Paper Co., Ltd., Tokyo (JP)

( * ) Notice: Subject to any disclaimer, the term of this patent is extended or adjusted under 35 U.S.C. 154(b) by 146 days.

(21) Appl. No.: 09/900,979

(22) Filed: Jul. 10, 2001

(65) Prior Publication Data

US 2002/0025418 A1 Feb. 28, 2002

(30) Foreign Application Priority Data

Jul. 11, 2000 (JP) ..... 2000-210221
Mar. 15, 2001 (JP) ..... 2001-073818

(51) Int. Cl.[7] ..... B41M 5/20

(52) U.S. Cl. ..... 503/200; 503/226; 428/209; 428/211; 428/195.1; 283/72

(58) Field of Search ..... 428/211, 209, 428/195; 503/226, 200; 283/72, 67; 250/556; 156/227; 162/104

(56) References Cited

U.S. PATENT DOCUMENTS 4,897,300 A 1/1990 Boehm ..... 428/195
5,002,636 A 3/1991 Crane ..... 162/104
5,501,938 A * 3/1996 Ellis et al. ..... 430/201
5,516,153 A * 5/1996 Kaule ..... 283/85
5,525,400 A * 6/1996 Manser et al. ..... 428/196
6,028,028 A * 2/2000 Nitta ..... 503/200
6,139,065 A * 10/2000 Washburn et al. ..... 283/67
6,199,911 B1 * 3/2001 Isherwood et al. ..... 283/83
2003/0186810 A1 * 10/2003 Kato et al. ..... 503/216

FOREIGN PATENT DOCUMENTS

| | | |
|---|---|---|
| DE | 197 06 049 A1 | 8/1998 |
| EP | 0 492 407 A1 | 7/1992 |
| GB | 1 357 489 A | 6/1974 |
| JP | 10-121319 | 5/1998 |
| JP | 10-315620 | 12/1998 |
| JP | 11-78326 | 3/1999 |

* cited by examiner

*Primary Examiner*—Rena Dye
*Assistant Examiner*—Tamra L. Dicus
(74) *Attorney, Agent, or Firm*—Kubovcik & Kubovick

(57) ABSTRACT

Disclosed are a paper support as well as a recording paper comprising the paper support and as formed thereon a recording layer, particularly a heat-sensitive recording layer, a transfer receiving layer for thermal fusion transfer recording or sublimation transfer recording or an ink receiving layer for ink-jet recording, the paper support having a security element embedded therein, the security element being a thread-shpaed or ribbon-shaped security element, and the paper support having a thickness which is at least 3 times the diameter of the thread-shaped security element or at least 3 times the thickness of the ribbon-shaped security element.

22 Claims, 2 Drawing Sheets

ANTIFALSIFICATION RECORDING PAPER AND PAPER SUPPORT THEREFOR

TECHNICAL FIELD

The present invention relates to a recording paper, and more specifically relates to an antifalsification recording paper.

BACKGROUND OF THE INVENTION

Known is a thermal recording material which forms a recorded portion by thermal energy from a thermal head using a color-forming reaction between an electron-donating compound and electron-accepting compound, a thermal fusion transfer or a sublimation transfer, or an ink jet recording material which obtains a recorded portion by ink jet. Since these recording materials are relatively inexpensive, usable with compact recording machines and easy to maintain, they are used as recording medium for facsimile and for computers, as well as in a wide range of fields.

Recently, various information recording materials have been rapidly improved in print stability and can record variable information at a high speed. Because of this advantage, these information recording materials have been used for betting tickets, lottery tickets, commuter passes, train tickets and the like. When the information recording materials are used for these applications, particularly for the pari-mutuel tickets and lottery tickets which have cashability, modification and counterfeit prevention is needed.

As a method for preventing counterfeit of the recording materials, for example, Japanese Unexamined Patent Publication No. 1999-165463 discloses adding watermark to a paper support; and Japanese Unexamined Patent Publication No. 1998-315620 discloses using a paper support having embedded therein a tape-shaped security element which has a film and a heat-sensitive recording layer formed on the film.

However, these conventional techniques have the following disadvantages: missing dots appear in recorded images, especially in the record images formed in the area where security element is embedded, degrading the quality of the recorded images; operation efficiency of production is low because wrinkles occur when supercalendering is effected; in the produced recording materials, the surface of the area where security elements are embedded are slightly thicker than the other parts, leading to a lack of smoothness (hereinafter referred to as "uneven thickness"); when the produced recording materials are rolled up, the roll is corrugated due to the uneven thickness.

An object of the present invention is to provide an antifalsification recording paper using a security element-embedded paper support, the recording paper being free of the quality degradation of recorded images such as missing dots on the surface of a recording layer at a security element portion (the portion at which a security element is embedded and its vicinity), free of uneven thickness on the surface of the recording material, occurrence of wrinkles during production and occurrence of corrugation when rolled up, and being easy to produce.

SUMMARY OF THE INVENTION

The recording material of the present invention is characterized in that it comprises a recording layer on a paper support within which a thread-shaped security element or a ribbon-shaped security element is embedded, the paper support having a thickness which is at least 3 times the diameter of the thread-shaped security element or at least 3 times the thickness of the ribbon-shaped security element.

The inventors of the present invention found that making the thickness of the paper support at least 3 times the diameter of the thread-shaped security element or at least 3 times the thickness of the ribbon-shaped security element can obviate the problems of the quality degradation of recorded images such as missing dots on the surface of a recording layer at a security element portion (the portion at which a security element is embedded and its vicinity), occurrence of wrinkles during production, uneven thickness on the surface of the recording material, occurrence of corrugation when rolled up, among others. Based on this finding and further investigation, the inventors accomplished the present invention.

The present invention provides the following recording materials.

1. A recording paper comprising a paper support and a recording layer formed on the paper support, the paper support having a security element embedded therein, the security element being a thread-shaped security element or a ribbon-shaped security element, and the paper support having a thickness at least 3 times the diameter of the thread-shaped security element or at least 3 times the thickness of the ribbon-shaped security element.

2. The recording paper according to item 1, in which the paper support has a thickness of 40 to 250 $\mu$m.

3. The recording paper according to item 1, in which the security element is a thread composed of natural fibers or synthetic fibers.

4. The recording paper according to item 1, in which the security element is a dyed thread, a thread having a vapor deposited metal layer or a thread combined with a metal foil.

5. The recording paper according to item 1, in which the security element is a thread-shaped security element having a diameter of about 10 $\mu$m to about 80 $\mu$m.

6. The recording paper according to item 1, in which the security element comprises a synthetic resin film and is a ribbon-shaped security element having a color different from that of the paper support.

7. The recording paper according to item 1, in which the security element is a ribbon-shaped security element comprising a synthetic resin film provided with a vapor deposited metel layer on at least one side thereof, the paper support having a thickness of at least 3 times the total thickness of the vapor deposited metal layer and the synthetic resin film.

8. The recording paper according to item 7, in which the vapor deposited metal layer is made of aluminum, copper, nickel, tin or zinc.

9. The recording paper according to item 1, in which the security element is a ribbon-shaped security element comprising a synthetic resin film or a metallized synthetic resin film, the ribbon-shaped security element having a width of about 0.3 mm to about 20 mm and a thickness of about 10 $\mu$m to about 80 $\mu$m.

10. The recording paper according to item 1, in which the security element has an adhesive layer comprising an adhesive as a main component on at least part of its surface.

11. The recording paper according to item 10, in which the adhesive layer adheres to the paper support by contact of the adhesive layer and water when the security element having the adhesive layer is embedded within the paper support during paper making, or by the heat applied when the paper is dried after production, or by the pressure applied during supercalendering.

12. The recording paper according to item 10, in which the adhesive is a polyester resin-based adhesive, a urethane resin-based adhesive, an acrylic resin-based adhesive or a vinyl acetate resin-based adhesive.

13. The recording paper according to item 10, in which the adhesive layer further comprises at least one member selected from the group consisting of a fluorescent dye, a fluorescent pigment and a luminescent pigment.

14. The recording paper according to item 10, in which the adhesive layer is prepared by uniformly dispersing an adhesive, and if desired at least one member selected from the group consisting of a fluorescent dye, a fluorescent pigment and a luminescent pigment, in water or an organic solvent serving as a medium to obtain a coating composition for forming an adhesive layer, applying the resulting coating composition for forming an adhesive layer to the thread-shaped security element or ribbon-shaped security element in an amount of about 1 $g/m^2$ to about 10 $g/m^2$ on a dry weight basis, and drying the resulting coating.

15. The recording paper according to item 1, in which the recording layer is a heat-sensitive recording layer comprising an electron-donating compound, electron-accepting compound and a binder.

16. The recording paper according to item 15, in which a protective layer containing a binder having a film forming ability is formed on the heat-sensitive recording layer.

17. The recording paper according to item 1, in which the recording layer is a transfer receiving layer for thermal fusion transfer recording or sublimation transfer recording.

18. The recording paper according to item 1, in which the recording layer is an ink-receiving layer for ink-jet recording.

19. The recording paper according to item 1, wherein an intermediate layer containing a pigment or hollow organic particles is provided between the paper support and the recording layer.

20. A paper support for a recording paper, the paper support having a security element embedded therein, the security element being a thread-shaped security element or a ribbon-shaped security element, and the paper support having a thickness of at least 3 times the diameter of the thread-shaped security element or at least 3 times the thickness of the ribbon-shaped security element.

21. The paper support according to item 20, which has a thickness of 40 to 250 $\mu$m.

22. The paper support according to item 20, in which the security element is a thread composed of natural fibers or synthetic fibers.

23. The paper support according to item 20, in which the security element is a dyed thread, a thread having a vapor deposited metal layer or a thread combined with a metal foil.

24. The paper support according to item 20, in which the security element is a thread-shaped security element having a diameter of about 10 $\mu$m to about 80 $\mu$m.

25. The paper support according to item 20, in which the security element comprises a synthetic resin film and is a ribbon-shaped security element having a color different from that of the paper support.

26. The paper support according to item 20, in which the security element is a ribbon-shaped security element comprising a synthetic resin film provided with a vapor deposited metel layer on at least one side thereof, the paper support having a thickness of at least 3 times the total thickness of the vapor deposited metal layer and the synthetic resin film.

27. The paper support according to item 26, in which the vapor deposited metal layer is made of aluminum, copper, nickel, tin or zinc.

28. The paper support according to item 20, in which the security element is a ribbon-shaped security element comprising a synthetic resin film or a metallized synthetic resin film, the ribbon-shaped security element having a width of about 0.3 mm to about 20 mm and a thickness of about 10 $\mu$m to about 80 $\mu$m.

29. The paper support according to item 20, in which the security element has an adhesive layer comprising an adhesive as a main component on at least part of its surface.

30. The paper support according to item 29, in which the adhesive layer adheres to the paper support by contact of the adhesive layer and water when the security element having the adhesive layer is embedded within the paper support during paper making, or by the heat applied when the paper is dried after production, or by the pressure applied during supercalendering.

31. The paper support according to item 29, in which the adhesive is a polyester resin-based adhesive, a urethane resin-based adhesive, an acrylic resin-based adhesive or a vinyl acetate resin-based adhesive.

32. The paper support according to item 29, in which the adhesive layer further comprises at least one member selected from the group consisting of a fluorescent dye, a fluorescent pigment and a luminescent pigment.

33. The paper support according to item 29, in which the adhesive layer is prepared by uniformly dispersing an adhesive, and if desired at least one member selected from the group consisting of a fluorescent dye, a fluorescent pigment and a luminescent pigment, in water or an organic solvent serving as a medium to obtain a coating composition for forming an adhesive layer, applying the resulting coating composition for forming an adhesive layer to the thread-shaped security element or ribbon-shaped security element in an amount of about 1 $g/m^2$ to about 10 $g/m^2$ on a dry weight basis, and drying the resulting coating.

DETAILED DESCRIPTION OF THE INVENTION

Figure 1:
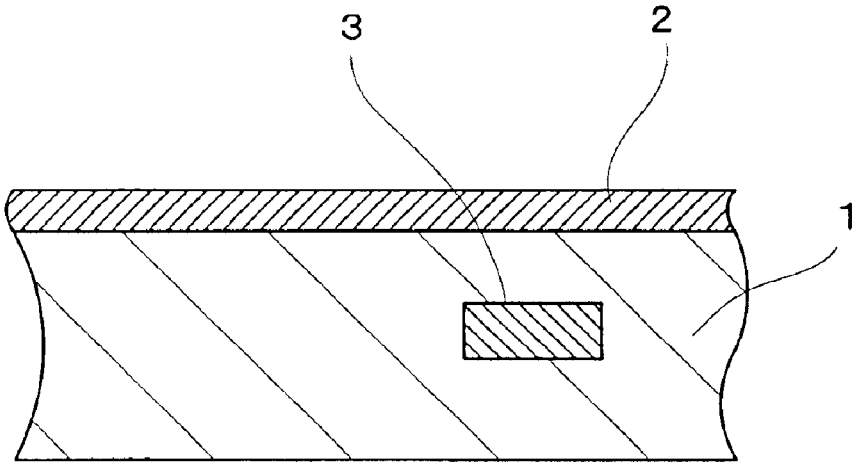
FIG. 1 is a cross-sectional view of the recording material according to one embodiment of the present invention.

In the embodiment shown in FIG. 1, a paper support 1 is provided with a recording layer 2 on one of its sides, and a security element 3 (a ribbon-shaped security element is shown in FIG. 1) is embedded within the paper support 1. It is also possible to embed one or more security elements within the paper support. In addition, a ribbon-shaped security element and a thread-shaped security element can be used in combination.

Paper Support

In a recording paper having a recording layer on a paper support, as a measure to solve the above-mentioned problems, the present invention uses a paper support which has embedded therein a thread-shaped security element or a ribbon-shaped security element and which has a thickness at least 3 times the diameter of the thread-shaped security element or at least 3 times the thickness of that of the ribbon-shaped security element.

When the thickness of the paper support is less than 3 times the diameter of the thread-shaped security element or the thickness of the ribbon-shaped security element, uneven thickness may occur, or a smoothing treatment with use of a supercalender or the like to improve the quality of a recorded image after the formation of the recording layer may cause wrincles. The thickness of the paper support is preferably about 4 times to about 10 times, particularly about 4 times to about 8 times the diameter of the thread-shaped security element or the thickness of the ribbon-shaped security element.

Figure 2:
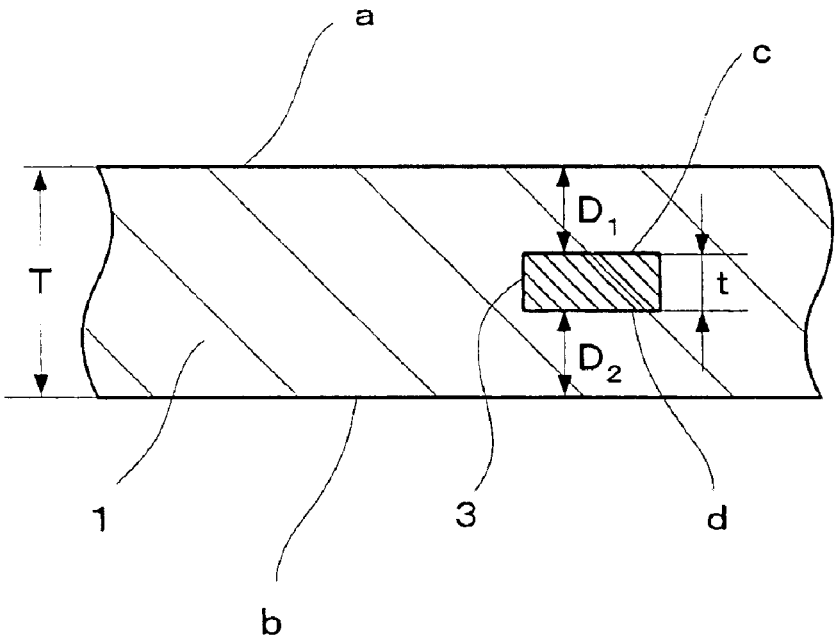
FIG. 2 is a cross-sectional view of the paper support for use in the present invention having a security element embedded therein.

FIG. 2 is a cross-sectional view of the paper support for use in the recording material of the present invention, the paper support having embedded therein a security element. The FIG. 2 shows the position of the security element embedded within the paper support. The position of the embedded security element is described referring to an example shown in FIG. 2 using a ribbon-shaped security element 3 below. When a thread-shaped security element is used, its embedded position is the same of that of the ribbon-shaped security element. As shown in FIG. 2, the security element 3 is embedded within the paper support 1 and therefore is present substantially in parallel with a surface a of the paper support 1 on the recording layer side and a surface b on the opposite side.

When the thickness of the paper support 1 is T and the thickness of the security element 3 is t, T is 3 times t or greater, preferably 4 times to 10 times t. The position of the security element 3 to be embedded in is not particularly limited, and the security element 3 is preferably embedded so that it does not appear on the surface of the paper support 1.

In general, the distance $D_1$ from the front surface a (on the recording layer side) of the paper support 1 to the front surface c (on the recording layer side) of the security element 3 is preferably about 1 to 7 times, particularly about 1.5 to about 5 times the thickness t of the security element 3. The distance $D_2$ from the rear surface b (the surface opposite of the front surface a on the recording layer side) of the paper support 1 to the rear surface d (the surface opposite of the front surface c on the recording layer side) of the security element 3 is preferably about 0.5 to 6 times, particularly about 0.5 to 4 times the thickness t of the security element. In the present invention, $D_1$ and $D_2$ can be selected from the above specified ranges, and the thickness of the elements can be suitably selected so that the total thickness of $D_1+D_2+t$ is 3 times or greater, preferably 4 to 10 times the thickness t of the security element. In particular, the security element 3 is preferably disposed in the center of the paper support (that is, a position which is about T/2 away from the front surface a on the recording layer side of the paper support 1, where $D_1$ and $D_2$ are equal or almost equal).

The thickness of the paper support is not particularly limited, and is preferably about 40 to 250 μm, particularly 60 to 200 μm. When the thickness of the paper support is less than 40 μm, it is difficult to embed the security element uniformly. When the thickness is greater than 250 μm, the recognition accuracy of the security element is lowered, and the counterfeit prevention property of the recording paper is impaired.

Papers useful as the paper support include those made from kraft pulp, sulfite pulp, ground pulp, thermomechanical pulp and like wood pulp from common softwoods and hardwoods, waste paper pulp, non-wood pulp and the like.

Security Element

Examples of the thread-shaped security element include threads made of cotton, hemp, silk and like natural fibers, and acrylic resin fibers, polyester resin fibers, nylon resin fibers and like synthetic fibers. Preferred thread-shaped security element may be a dyed thread, a thread having a vapor deposited metal layer and a thread combined with a metal foil because they are excellent in counterfeit prevention property.

The thickness (diameter) of these thread-shaped security elements is preferably about 10 to 80 μm, particularly about 10 to 40 μm. When the thread-shaped security element has a dyed layer, a vapor deposited metal layer, a metal foil and the like, the thickness of the paper support is at least 3 times the total thickness (diameter) of the security element including them.

Examples of the ribbon-shaped security element include those comprising a non-oriented or biaxially oriented synthetic resin film. Specific examples of the synthetic resin films include 6,6-nylon film, polyethylene terephthalate film, polyethylene film, polyethylene naphthalate film, polypropylene film and the like.

Such ribbon-shaped security elements include a colored security element made of such resin film, particularly a security element colored differently from the paper support, and the above synthetic resin films having a vapor deposited metal layer of aluminum, copper, nickel, tin, zinc or the like, and they are preferred because of their excellent counterfeit prevention property.

When the synthetic resin film having a vapor deposited metal layer is used as the ribbon-shaped security element, the vapor deposited metal layer may be provided on either the front surface or the rear surface of the resin film, or on both of the front surface and the rear surface. The vapor deposited metal layer usually have a thickness conventionally employed for counterfeit prevention, and ranges, for example, from about 0.05 μm to about 1.0 μm. The security element made of a resin film having a vapor deposited metal layer can be produced in a conventional manner, for example, by slitting, in the above-specified width, various commercially available metallized films having a thickness within the above-specified range.

The width of the above ribbon-shaped security element is preferably about 0.3 to 20 mm, particularly about 0.5 to 5 mm. It is recommended that the thickness of the above ribbon-shaped security element (the total thickness of the vapor deposited metal layer and resin film in the case of a metallized film) is about 10 to 80 μm, preferably about 10 to about 40 μm.

When the ribbon-shaped security element is a resin film having a vapor deposited metal layer, the thickness of the paper support is at least 3 times the total thickness of the vapor deposited metal layer and the resin film.

In the present invention, an adhesive layer containing an adhesive as a main component may be provided, if necessary, on at least part of the surface of the thread-shaped security element or ribbon-shaped security element, whereby the bonding between the security element and pulp fibers within the paper is strengthened. This improves the effect of preventing the security element from being removed from the paper during printing process or cutting process. When the ribbon-shaped security element (including colored security elements and security elements having a vapor deposited metal layer) is used, the adhesive layer may be provided on either the front surface or rear surface of the ribbon-shaped security element, or on both of the front surface and rear surface.

The adhesive in the adhesive layer is not particularly limited and includes a water-based (water-soluble or latex-based) adhesive, an organic solvent-based adhesive or the like. Examples of the adhesive are a polyester resin-based adhesive, a urethane resin-based adhesive, an acrylic resin-based adhesive or a vinyl acetate resin-based adhesive.

The adhesive layer is adhered to the paper by contact with water when the security element provided with the adhesive layer is embedded within the paper support during paper making, or by the heat applied for drying the produced paper, or by the pressure applied during supercalender process or the like.

Further, the adhesive layer may contain, if necessary, at least one member selected from the group consisting of a fluorescent dye, a fluorescent pigment and a luminescent pigment, whereby the counterfeit prevention effect is further enhanced.

The adhesive layer may be prepared by uniformly dispersing the above adhesive, and if desired at least one of a fluorescent dye, a fluorescent pigment and a luminescent pigment, using water or an organic solvent as a medium to prepare a coating composition for forming an adhesive layer, applying the coating composition to the thread-shaped security element or ribbon-shaped security element by roll coating, bar coating, gravure coating or like method, and drying the resulting coating. The amount of the coating composition to be applied is preferably about 1 to 10 g/m$^2$, particularly about 2 to 8 g/m$^2$, on a dry weight basis.

In the present invention, when the thread-shaped security element or ribbon-shaped security element has an adhesive layer, the thickness of the paper support is at least 3 times the diameter of the thread-shaped security element itself, or at least 3 times the thickness of the ribbon-shaped security element itself, excluding the thickness of the adhesive layer.

Figure 3:
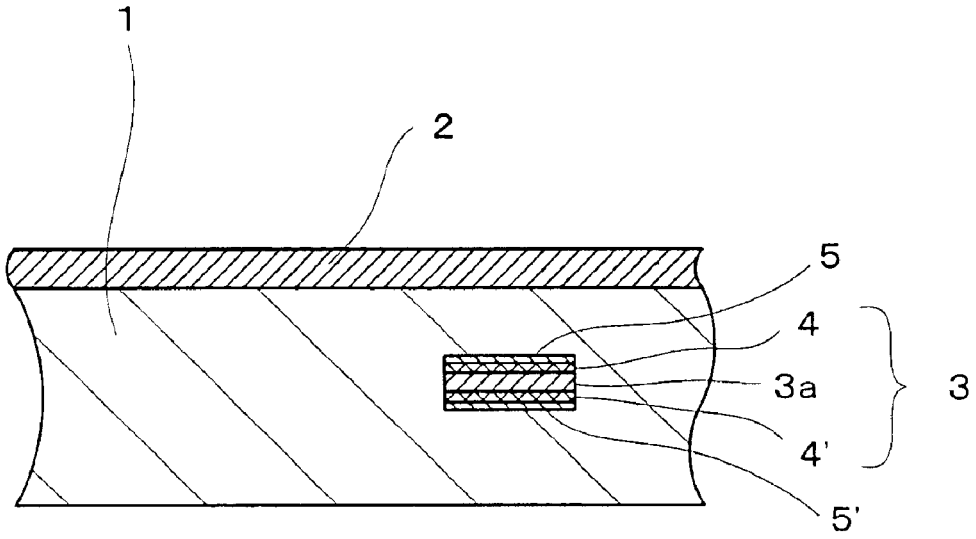
FIG. 3 is a cross-sectional view showing an example of the recording material of the present invention having the paper support which has embedded therein a ribbon-shaped security element provided with a vapor deposited metal layer and an adhesive layer.

FIG. 3 shows an example of the recording material of the present invention comprising a paper support which has embedded therein a ribbon-shaped security element having vapor deposited metal layers and adhesive layers. In FIG. 3, the elements are labeled with the same numerals used in FIG. 1. In the embodiment shown in FIG. 3, the security element 3 is a metallized film comprising a resin film 3*a* provided with a vapor deposited metal layers 4, 4' on both sides thereof. In addition, it is possible to use, as the security element 3, a resin film 3*a* provided with either one of the vapor deposited metal layers 4 and 4' on either side thereof.

In FIG. 3, the adhesive layers 5, 5' are provided on both sides of the security element 3, but the adhesive layer may be provided only on the front surface (on the recording layer side) of the security element 3, or may be provided only on the rear surface (opposite of the recording layer side) of the security element 3.

The method for embedding a security element within the paper support is not particularly limited, and may be a conventional method. For example, the security element and the paper can be bonded using a combination paper machine by combining first and second wet webs and simultaneously inserting a thread-shaped security element or ribbon-shaped security element between the first and second wet webs, combining the resulting laminate with one or more wet webs, followed by drying.

For example, the paper support can be prepared with use of a cylinder paper machine having three cylinder vats by forming a first wet web with a first cylinder, forming a second wet web with a second cylinder, inserting a security element, for example, at intervals of 10 cm, between the first wet web and the second wet web which is still on the second cylinder and is about to leave the second cylinder, further combining the resulting laminate with a third wet web formed by a third cylinder, and drying the resulting combination web by heating in a conventional manner to thereby obtain the paper support of the present invention. In the above procedure, the position of the security element to be embedded can be controlled by suitably adjusting the thickness of the first, second and third webs.

Recording Layer

The recording layer is not particularly limited, but is preferably a heat-sensitive recording layer which can form recorded portions with a thermal head and contains an electron-donating compound, an electron-accepting compound and a binder; a transfer receiving layer for thermal fusion transfer recording or sublimation transfer recording; or an ink-receiving layer for ink-jet recording, since these recording layers can readily record variable information.

(1) Heat-Sensitive Recording Layer

As mentioned above, according to one embodiment of the present invention, the recording layer formed on at least one side of the paper support in which the thread-shaped security element or ribbon-shaped security element is embedded is a heat-sensitive recording layer which can form recorded portions (=recorded images) with a thermal head and contains an electron-donating compound, an electron-accepting compound and a binder.

Examples of the combination of the electron-donating compound and electron-accepting compound in the heat-sensitive recording layer include a combination of a leuco dye and a color developer; a combination of a diazonium salt and a coupler; a combination of a chelate compound and a transition element such as iron, cobalt, copper and the like; a combination of an imino compound and an aromatic isocyanate compound; among others. The combination of the leuco dye and color developer is preferably used because of its excellent recorded image optical density. In the description that follows, the recording layer having a combination of an electron-donating compound, i.e., leuco dye, and an electron-accepting compound, i.e., color developer, is described in detail.

The leuco dye contained in the recording layer is not particularly limited, and various conventionally known leuco dyes can be used. Examples of the leuco dyes include 3,3-bis(p-dimethylaminophenyl)-6-dimethylaminophthalide, 3-diethylamino-7-anilinofluoran-3-cyclohexylamino-6-chlorofluoran, 3-diethylamino-6-methyl-7-chlorofluoran, 3-diethylamino-7-chlorofluoran, 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-diethylamino-7-(o-chloroanilino)fluoran, 3-di(n-butyl)amino-7-(o-fluoroanilino)fluoran, 3-(N-ethyl-p-toluidino)-6-methyl-7-anilinofluoran, 3-(N-ethyl-N-tetrahydrofurfurylamino)-6-methyl-7-anilinofluoran, 3,3-bis[1-(4-methoxyphenyl)-1-(4-dimethylaminophenyl)ethylene-2-yl]-4,5,6,7-tetrachlorophthalide and the like.

Examples of the color developer include 4,4'-isopropylidenediphenol, 1,1-bis(4-hydroxyphenyl) cyclohexane, benzyl 4-hydroxybenzoate, 4,4'-dihydroxydiphenylsulfone, 2,4'-dihydroxydiphenylsulfone, 4-hydroxy-4'-isopropoxydiphenylsulfone, bis(3-allyl-4-hydroxyphenyl)sulfone, 4-hydroxyphenyl-4'- benzyloxyphenylsulfone, 1,4-bis[α-methyl-α-(4'-hydroxyphenyl)ethyl]benzene, 2,2'-thiobis(3-tert-octylphenol) and like phenolic compounds, N,N'-di-m-chlorophenylthiourea and like thiourea compounds, N-(p-tolylsulfonyl)carbamic acid-p-cumylphenyl ester, N-(p-tolylsulfonyl)carbamic acid-p-benzyloxyphenyl ester, N-(p-tolylsulfonyl)-N'-(p-tolyl)urea and like compounds containing —$SO_2NH$— bond(s) in the molecule, zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate and like zinc salts of aromatic carboxylic acids.

The amount of the leuco dye to be used is about 5 to 30% by weight, preferably about 5 to 20% by weight, based on the total solids content of the recording layer. The amount of the color developer used is about 5 to 40% by weight, preferably about 10 to 30% by weight, based on the total solids content of the recording layer.

The ratio of the leuco dye to the color developer used may be suitably selected depending on the kinds of the leuco dye and color developer used and is not particularly limited. Generally, the color developers are used in an amount of 1 to 10 parts by weight, preferably about 2 to 6 parts by weight, per part by weight of the leuco dyes.

The heat-sensitive recording layer may contain a print stability-improving agent to enhance the storage stability of the recorded portions (i.e., recorded images) and/or a sensitizer to enhance recording sensitivity. Examples of the print stability-improving agent include 2,2'-ethylidenebis(4,6-di-tert-butylphenol), 4,4'-thiobis(2-methyl-6-tert-butylphenol), 1,1,3-tris(2-methyl-4-hydroxy-5-tert-butylphenyl)butane, 1,1,3-tris(2-methyl-4-hydroxy-5-cyclohexylphenyl)butane, 2,2-bis(4-hydroxy-3,5-dimethylphenyl)propane and like hindered phenol compounds, 4-benzyloxy-4'-(2-methylglycidyloxy) diphenylsulfone, diglycidyl terephthalate, phenol novolac epoxy resin, bisphenol A epoxy resin and like epoxy compounds.

Examples of the sensitizer include stearic acid amide, methylenebisstearamide, 2-naphthylbenzyl ether, m-terphenyl, p-benzylbiphenyl, di(p-methoxyphenoxyethyl)ether, 1,2-di(3-methylphenoxy) ethane, 1,2-di(4-methylphenoxy)ethane, 1,2-di(4-methoxyphenoxy)ethane, 1,2-diphenoxyethane, 1,4-di (phenylthio)butane, p-acetotoluidide, p-acetophenetidide, N-acetoacetyl-p-toluidine, di(β-biphenylethoxy)benzene, di(p-chlorobenzyl) oxalate, di(p-methylbenzyl) oxalate, ibenzyl oxalate and the like.

When the print stability-improving agent and the sensitizer is used, the respective amounts thereof are not particularly limited, but each of them may be used in an amount of about 1 to 4 parts by weight per part by weight of the color developer.

The heat-sensitive recording layer is formed by the following process. First, a leuco dye, a color developer, and if necessary, a sensitizer, a print stability-improving agent and the like are dispersed in water serving as a dispersion medium, either simultaneously or separately, by means of a ball mill, an attritor, a sand mill or like stirrer or a pulverizer until an average particle diameter of 3 μm or smaller, preferably 2 μm or smaller is attained. Then, a coating composition for forming the heat-sensitive recording layer is prepared by adding at least a water-based binder (water-soluble or water-dispersible binder), and then applied to the paper support, and the resulting coating on the paper support is dried.

Examples of the aqueous binder to be added to the coating composition for forming heat-sensitive recording layer include starches, methylcellulose, carboxymethylcellulose, casein, gum arabic, polyvinyl alcohol, carboxy-modified polyvinyl alcohol, diacetone-modified polyvinyl alcohol, acetoacetyl-modified polyvinyl alcohol, silicon-modified polyvinyl alcohol, diisobutylene-maleic anhydride copolymer salts, styrene-maleic anhydride copolymer salts, ethylene-acrylic acid copolymer salts, styrene-acrylic acid copolymer salts and like water-soluble binders, urethane resin-based latex, acrylic resin-based latex, acrylonitrile-butadiene resin-based latex, styrene-butadiene resin-based latex and like water-dispersible binders.

The amount of the binder used is about 5 to 40% by weight, preferably about 8 to 30% by weight, based on the total solids content of the heat-sensitive recording layer.

If necessary, the coating composition for forming heat-sensitive recording layer may further contain various auxiliaries, for example, kaolin, calcium carbonate, calcined kaolin, amorphous silica, aluminium hydroxide, urea-formalin resin filler and like pigments having an average particle diameter of about 0.1 to 5 μm, sodium dioctylsulfosuccinate, sodium dodecylbenzene sulfonate, sodium lauryl sulfate, fatty acid metal salts and like dispersants, zinc stearate, calcium stearate, polyethylene wax, carnauba wax, paraffin wax, ester wax and like waxes, deforming agents, cross-linking agents, coloring dyes, etc.

The amount of the coating composition for forming heat-sensitive recording layer to be applied may be selected from a wide range. In general, it is recommended that the amount is about 3 to 15 g/$m^2$, preferably about 4 to 10 g/$m^2$ on a dry weight basis.

If necessary, a protective layer containing a binder having a film forming ability may be provided on the heat-sensitive recording layer. The protective layer is formed, for example, by mixing the binder which can be added to the above coating composition for forming heat-sensitive recording layer and, if necessary, the auxiliaries (particularly the above pigment) which can be added to the coating composition for forming heat-sensitive recording layer, using water as a medium, stirring the mixture, applying the obtained coating composition for forming protective layer on the recording layer and drying the coating.

The amount of the binder to be used is about 20% to about 90% by weight, preferably about 20 to 70% by weight, based on the total solids content of the protective layer. The above auxiliary (especially the pigment), if employed, is used in an amount of about 10 to 70% by weight, preferably about 30 to about 60% by weight, based on the total solids content of the protective layer.

The amount of the coating composition for forming protective layer used may be suitably selected from a wide range. In general, it is recommended that the amount is about 0.5 to 6 g/$m^2$, preferably about 2 to 5 g/$m^2$, on a dry weight basis.

(2) Transfer Receiving Layer

According to another embodiment of the present invention, the recording layer formed on the paper support in which the above thread-shaped security element or ribbon-shaped security element is embedded is a transfer receiving layer for thermal fusion transfer recording or sublimation transfer recording.

A recorded portion is formed on the transfer receiving layer for thermal fusion transfer recording or sublimation transfer recording transfer in the recording material of the present invention. The recorded portion is made with a thermal transfer sheet having a thermal transfer layer comprising a coloring dye and a wax as main components or a sublimable dye and a binder as main components. The thermal transfer layer is transferred from the thermal transfer sheet onto the transfer receiving layer of the recording material by a thermal head.

<Transfer Receiving Layer for Thermal Fusion Transfer Recording>

The transfer receiving layer for thermal fusion transfer recording can be formed, for example, by applying a coating composition for forming transfer receiving layer which contains water (as a medium), and a pigment and a binder as main components on the paper support of the present invention in an amount of about 2 to 20 g/m$^2$, preferably about 3 to 10 g/m$^2$ on a dry weight basis, and drying the coated paper support.

The amount of the pigment used is about 40 to 90% by weight, preferably about 50 to 80% by weight of the transfer receiving layer; and the amount of the binder used is about 10 to 40% by weight, preferably about 15 to 30% by weight of the transfer receiving layer.

Examples of the binder include those contained in the above heat-sensitive recording layer. The transfer receiving layer may further contain various auxiliaries which may be added to the heat-sensitive recording layer.

Examples of the pigment include zinc oxide, titanium oxide, calcium carbonate, kaolin, talc, mica, calcined kaolin, aluminum hydroxide, barium sulfate, lithopone, amorphous silica and like inorganic pigments, polystyrene filler, nylon resin filler, urea-formalin resin filler and like organic pigments. The form of such pigments is spherical, hollow, amorphous, needle-like, cube-like, etc. These pigments may be used singly or at least two of them may be used in admixture, depending on the situation.

<Transfer Receiving Layer for Sublimation Transfer Recording>

The transfer receiving layer for sublimation transfer recording is formed by applying a coating composition for forming transfer receiving layer to a paper support and drying the coated paper support. The coating composition comprises water or an organic solvent as a medium, and, for example a resin, a cross-linking agent and a blocking inhibitor, etc., as main components. The coating composition is applied to the paper support in an amount of about 0.1 to 20 g/m$^2$, preferably about 0.5 to 10 g/m$^2$ on a dry weight basis.

Preferable examples of the above resin include acrylic resins, urethane resins, styrene resins, acetate resins, polyester resins and like hydrophobic resins. Among these, acetate resin and polyester resins are favorable because of their high effect of receiving sublimable dye. The amount of the resin used may be selected from a wide range. In general, the amount is about 40 to 95% by weight, preferably about 50 to 90% by weight, of the transfer receiving layer.

Examples of the cross-linking agent include isocyanate compounds, epoxy compounds, oxazoline compounds, carbodiimide compounds and the like. The amount of the cross-linking agent used may be selected from a wide range. In general, the amount may be about 0.1 to 20% by weight, preferably about 1 to 10% by weight, of the transfer receiving layer.

Examples of the blocking inhibitor include silicone resins, silicone oils, zinc stearate, calcium stearate, zinc oleate, paraffin wax, distearyl phosphate and like compounds having mold release characteristics. The amount of the blocking inhibitor used may be selected from a wide range. In general, the amount may be about 0.1 to 15% by weight, preferably about 0.5 to 10% by weight, of the transfer receiving layer.

If necessary, the transfer receiving layer for sublimation transfer recording may further contain benzotriazole-based, benzophenone-based, phenyl salicylate-based, cyanoacrylate-based ultraviolet absorber, zinc oxide, titanium oxide, calcium carbonate, kaolin, talc, mica, calcined kaolin, aluminum hydroxide, barium sulfate, amorphous silica and like pigments.

<Thermal Transfer Sheet>

An image is recorded on the above transfer receiving layer which is formed on the paper support of the present invention by superposing a thermal transfer sheet having a thermal transfer layer on a base sheet in such a manner that the thermal transfer layer faces the transfer receiving layer and heating the rear side of the thermal transfer sheet with a thermal head to thereby transfer the thermal transfer layer onto the transfer receiving layer.

An example of the above thermal transfer sheet typically has a thermal transfer layer which comprises a coloring dye and a wax as main components or a sublimable dye and a binder as main components on a substrate sheet having a thickness of about 5 to 40 $\mu$m.

Examples of such substrate sheet are glassine papers, polyethylene terephthalate films, polycarbonate films, nylon films and the like.

Examples of the wax usable for the thermal transfer layer for thermal fusion transfer recording comprising the coloring dye and the wax as main components are compounds having a melting point of about 40 to 120° C. and mainly comprising higher aliphatic groups, such as higher fatty acids, higher alcohols, higher fatty acid amides, higher fatty acid esters, paraffins, polyethylene waxes and the like.

Examples of the wax include carnauba wax, montan wax, paraffin wax, polyethylene wax, palmitic acid, stearic acid, behenic acid, myristic acid, methyl stearate, stearic acid anilide, stearic acid amide, behenic acid amide, ethylene bisstearamide, stearyl alcohol and the like. The amount of the wax used can be selected from a wide range, but is generally about 30 to 97% by weight, preferably about 40 to 90% by weight, of the total solids content of the thermal transfer layer.

Examples of the coloring dye include azo dyes, anthraquinone dyes, phthalocyanine dyes, indigo dyes, thioindigo dyes, diphenylmethane dyes, triphenylmethane dyes, polymethine dyes, azomethine dyes, xanthene dyes, acridine dyes, cyanine dyes, quinoline dyes, naphthoquinone dyes and like organic dyes; carbon black, prussian blue, ultramarine blue and like inorganic coloring pigments. The amount of the coloring dye used may be selected from a wide range, but is generally about 1 to 30% by weight, preferably about 5 to 20% by weight, based on the total solids content of the thermal transfer layer.

The thermal transfer layer is formed of a coating composition for forming thermal transfer layer which typically comprises a wax and a coloring dye as main components. The coating composition for forming thermal transfer layer is applied, for example, by hot-melt coating to one side of the substrate sheet in an amount of about 1 to 8 g/m$^2$, preferably about 2 to 7 g/m$^2$.

The thermal transfer layer comprising a sublimable dye and a binder as main components is formed of a coating composition for forming thermal transfer layer which comprises an organic solvent such as toluene, methyl ethyl ketone, methanol, ethanol or the like as a medium, and, a sublimable dye such as anthraquinone dye, azo dye, styryl dye, quinophthalene dye or the like, and a binder. The coating composition for forming thermal transfer layer is applied to the substrate sheet in an amount of about 0.5 to 20 g/m$^2$, preferably about 1.0 to 10 g/m$^2$, on a dry weight basis, and then the coated base sheet is dried.

Examples of the binder include acrylic resin binders, urethane resin binders, styrene resin binders and the like.

The amount of sublimable dye used is about 1 to 50% by weight, preferably about 2 to 30% by weight, of the thermal transfer layer. The amount of the binder used is about 5 to 70% by weight, preferably about 10 to 50% by weight, of the thermal transfer layer.

<Thermoplastic Resin Film Layer>

Optionally, a thermoplastic resin film layer can be provided between the paper support and the thermal transfer receiving layer, and/or on the rear side of the paper support. When an intermediate layer to be mentioned below is provided, the thermoplastic resin film layer may be provided between the intermediate layer and the transfer receiving layer for sublimation transfer recording. The thermoplastic resin film layer is formed, for example, by dry lamination, wet lamination, extrusion laminating, wax lamination or like conventional methods. Among these methods, dry lamination is used commonly.

A mixture of a polymeric adhesive substance (polyether-based, polyester-based, etc.) and a curing agent (polyisocyanate-based, epoxy-based, etc.) is often used as the adhesive for forming a thermoplastic resin film layer in the above dry lamination. The amount of the adhesive applied is preferably in the range of about 1 to 20 g/m$^2$. In order to maintain a curl balance, it is preferable that the thicknesses of the adhesive layers on both sides are the same. In addition, extrusion lamination is preferably used to improve the image quality.

(3) Ink-Receiving Layer for Ink-Jet Recording

According to another embodiment of the present invention, the recording layer formed on at least one side of the above paper support of the present invention in which the thread-shaped security element or ribbon-shaped security element is embedded is an ink-receiving layer for ink-jet recording.

The ink-receiving layer for ink-jet recording comprises at least a pigment, and preferably comprises a pigment and a binder. When the pigment have an anionic surface as colloidal silica, amorphous silica, etc. and the liquid ink has an anionic dye, the ink-receiving layer preferably comprises a cationic resin in addition to the pigment and the binder. When the surface of the pigment is cationic as alumina hydrate and the like, it is not necessary to add a cationic resin to the ink-receiving layer.

Examples of the pigment useful for ink-receiving layer include zeolite, precipitated calcium carbonate, ground calcium carbonate, magnesium carbonate, kaolin, talc, calcium sulfate, barium sulfate, titanium oxide, zinc oxide, zinc sulfide, zinc carbonate, satin white, aluminium silicate, diatomaceous earth, calcined clay, calcium silicate, magnesium silicate, colloidal silica, amorphous silica, aluminum hydroxide, colloidal alumina, alumina, alumina hydrate and like pigments which are used in coating agents for general coated papers. Preferable examples of the pigment useful for the ink-receiving layer include colloidal silica, amorphous silica, aluminum hydroxide, alumina and alumina hydrate. These pigments may be used singly or at least two of them may be used in admixture. The amount of the pigment used may be selected from a wide range, but is generally about 50 to 95% by weight, particularly about 70 to 90% by weight, based on the total solids content of the ink-receiving layer.

In the present invention, a coating composition prepared by dispersing the above pigment is applied on the paper support and the coated paper support is dried to form an ink-receiving layer on at least one side of the paper support. In this procedure, if the particle diameter of the pigment is too large, the ink-receiving layer becomes whitish and opaque, whereby it becomes difficult to visually observe the security element embedded in the paper support. This lowers the effects of the present invention to prevent counterfeit. Accordingly, the particle diameter of the pigment used for the ink-receiving layer is preferably within the range which gives transparency to the ink-receiving layer and allows the security element within the paper support under the ink-receiving layer to be visually observed. The researches of the inventors of the present invention revealed that the secondary particle diameter of the pigment which meets the above requirements is 700 nm or smaller, preferably 500 nm or smaller. In the present specification, the average particle diameter of the secondary particle was determined under a transmission electron microscope (TEM; product name "H-300", manufactured by Hitachi Ltd.).

As mentioned above, in the present invention, a cationic resin may be added to the ink-receiving layer to enhance the water resistance of the recorded portion. Examples of the cationic resin useful for the ink-receiving layer include polydiallylamine hydrochloride, diallylamine hydrochloride-acrylamide copolymers, diallylamine hydrochloride-sulfur dioxide copolymers, polydiallyldimethylammonium chloride, diallyldimethylammonium chloride-acrylamide copolymers, diallyldimethylammonium chloride-sulfur dioxide copolymers, polyallylamine hydrochloride, allylamine hydrochloride-diallylamine hydrochloride copolymers, N-vinylacrylamidine hydrochloride-acrylamide copolymers, addition polymerization product of epichlorohydrin and dialkylamine, polyamide-polyamine-epichlorohydrin polymers, polycondensates of dicyandiamide and formalin, polycondensates of dicyandiamide and polyethyleneamine, polyethylene imine hydrochloride, poly(meth) acryloyloxyalkyltrialkylammonium chloride, poly(meth) acryloyloxyalkyltrialkylammonium chloride-acrylamide copolymers, poly(meth)acrylamidealkyltrialkylammonium chloride, poly(meth)acrylamidealkyltrialkylammonium chloride-acrylamide copolymers and the like. These may be used singly or at least two of them may be used in combination.

The amount of the cationic resin is controlled within the range from 1 to 100 parts by weight, preferably from 5 to 50 parts by weight, per 100 parts by weight of the pigment. When the amount is too low, the water resistance of the recorded images, record image density and like properties are not effectively enhanced. When the content is too high, the record image density may be lowered and the images are likely to suffer feathering.

The ink-receiving layer contains at least a pigment, but it preferably comprises a binder in addition to the pigment to stably fix on the paper support. Examples of the binder useful for the ink-receiving layer are oxidized starch, etherified starch and like starch derivatives, carboxymethylcellulose, hydroxyethylcellulose and like cellulose derivatives, casein, gelatin, soybean protein, completely saponificated polyvinyl alcohol, partially saponificated polyvinyl alcohol, silicon-modified polyvinyl alcohol, diacetone-modified polyvinyl alcohol, acetoacetyl-modified polyvinyl alcohol, carboxy-modified polyvinyl alcohol, styrene-maleic anhydride copolymer salts, styrene-butadiene latex, acrylic resin latex, polyester polyurethane latex, vinyl acetate latex and like water-based binders; polymethyl methacrylate, polyurethane resin, unsaturated polyester resin, vinyl chloride-vinyl acetate copolymers, polyvinyl butyral, alkyd resin and like resin which are soluble in organic solvents. These may be used singly or at least two of them may be used in combination.

The amount of these binders used ranges from about 1 to 100 parts by weight, preferably about 5 to 50 parts by weight, per 100 parts by weight of the pigment.

The ink-receiving layer may further contain dispersing agents, thickening agents, cross-linking agents, fluidity modifiers, defoaming agents, foam inhibitors, mold releasing agents, foaming agents, penetrating agents, coloring dyes, coloring pigments, fluorescent whitening agents, preservatives, anti-septic agents, insolubilizers, light stabilizers, ultraviolet absorbers and the like, if necessary.

The ink-receiving layer is formed by applying a coating composition for forming ink-receiving layer on at least one side of the paper support in an amount of about 2 to 40 g/m$^2$ on a dry weight basis and drying the coating composition. Alternatively, the ink-receiving layer can be formed by applying the coating composition on a converted paper such as a super-smooth film, drying the composition and transferring the dried composition to a paper support. When the amount of the coating composition applied is less than 2 g/m$^2$ the quality of the recorded images is deteriorated. When the amount is greater than 40 g/m$^2$, the security element within the paper support under the ink-receiving layer is hard to be visually observed. Preferable amount of the coating composition applied is about 5 to 30 g/m$^2$ on a dry weight basis. The ink-receiving layer may be formed with one application, or dividedly with several applications. A plurality of ink-receiving layers comprising different coating compositions may be formed insofar as the security element within the paper support can be visually observed.

Further, a gloss layer may be provided on the ink-receiving layer and subjected to a casting treatment, or the ink-receiving layer itself may be directly subjected to a casting treatment, whereby an ink jet recording paper with superior surface glossiness can be obtained. The casting treatment includes wet casting method, gelation casting method and re-wet casting method. In the wet casting process, a gloss layer coating liquid applied to the paper support is brought, while the layer is kept in wet condition, into contact under pressure with a mirror-finished casting surface of a heated casting drum, to thereby create a highly glossy finish. In the gelation casting method, a gloss layer coating liquid applied to the paper support is brought, while the layer is kept in wet condition, into contact with a gelling agent bath and the resulting gelled gloss layer is brought under pressure into contact with a mirror-finished casting surface of a heated casting drum, to thereby create a highly glossy finish. In the re-wet casting method, a wet gloss layer coating liquid applied is dried and then brought into contact with a wetting liquid and the resulting re-wetted gloss layer is brought under pressure into contact with a mirror-finished casting surface of a heated casting drum, to thereby create a highly glossy finish.

The liquid ink for forming recorded images is a recording liquid which comprises a dye-based or colored pigment-based coloring agents, a liquid medium such as water, a mixture of water and an organic solvent, an organic solvent or the like, and other additives. Examples of the dye-based coloring agents include water-soluble or oil-soluble direct dyes, acid dyes, reactive dyes and like water-soluble dyes. Examples of the colored pigment-based coloring agents are disclosed in Japanese Unexamined Patent Publications No. 1992-234467, No. 1994-100810 and No. 1997-123593, among others.

Examples of the liquid medium of the liquid ink are water and a mixture of water and a water-soluble organic solvent. Examples of the water-soluble organic solvent include ethyl alcohol, isopropyl alcohol and like monohydric alcohol, ethylene glycol, diethylene glycol, polyethylene glycol, glycerin and like polyhydric alcohol, triethylene glycol monomethyl ether, triethylene glycol monoethyl ether and like lower alkyl ethers of polyhydric alcohols and the like. Examples of the organic solvent for dissolving the oil-soluble dye include the above-mentioned ethyl alcohol, isopropyl alcohol and like monohydric alcohols, ethyleneglycol, diethylene glycol, polyethylene glycol, glycerin and like polyhydric alcohols, triethylene glycol monomethyl ether, triethylene glycol monoethyl ether and like lower alkyl ethers of polyhydric alcohols.

Examples of other additives include pH adjusting agents, metal sequestering agents, anti-septic agents, viscosity modifiers, surfactants, rust-inhibitors and the like.

Intermediate Layer

In the present invention, an intermediate layer comprising a pigment and a binder as main components may be provided, if so desired, between the paper support and the recording layer. When the recording layer is a transfer receiving layer for sublimation transfer recording, and a thermoplastic resin film layer is provided, the intermediate layer may be provided between the paper support and the thermoplastic resin film layer. Providing the intermediate layer can remarkably inhibit uneven thickness of the recording paper and corrugation in a roll of the recording paper.

Examples of the above pigment include inorganic pigments having an average particle diameter of about 0.1 to 5 $\mu$m such as calcium carbonate, kaolin, talc, calcined kaolin, amorphous silica, synthetic aluminium silicate, zinc oxide, titanium oxide, aluminum hydroxide and the like; organic pigments having an average particle diameter of about 0.5 to 30 $\mu$m such as urea-formalin resin fillers, hollow acrylic resin fillers, hollow styrene resin fillers, hollow vinylidene chloride resin fillers and the like. Particularly, preferable are the hollow organic particles having excellent cushioning characteristics such as hollow acrylic resin fillers, hollow styrene resin fillers, hollow vinylidene chloride resin fillers and the like. The amount of these pigments used is preferably about 30 to 90% by weight, particularly about 40 to 80% by weight, based on the total solids content of the intermediate layer.

Examples of the binder used in the intermediate layer include those which are usable in the above recording layer (especially in the heat-sensitive recording layer). The amount of the binder used is preferably about 5 to 30% by weight, particularly about 10 to 25% by weight, based on the total solids content of the intermediate layer.

The intermediate layer is formed by applying a coating composition for forming intermediate layer on the front surface (on the recording layer side) of the paper support and drying the coating composition. The coating composition for forming intermediate layer is prepared, for example, by mixing the above pigment, the binder, and if necessary, the auxiliaries which can be added to the coating composition for forming recording layer (especially the heat-sensitive recording layer), in water serving as a medium, and stirring the mixture.

The amount of the coating composition for forming intermediate layer applied may be suitably selected from a wide range, but is generally about 5 to 15 g/m$^2$, preferably about 6 to 12 g/m$^2$, on a dry weight basis.

Examples of the method for applying the coating compositions for recording layer, intermediate layer and protective layer include air knife coating, Mayer bar coating, pure blade coating, rod blade coating, reverse roll coating, gravure coating, slit die coating, curtain coating and the like.

In addition, the recording paper of the present invention may be processed, for example, using supercalender, gloss calender to improve surface smoothness by allowing it to pass between roll nips after forming the recording layers to impart smoothness to the recording paper or for other purposes. It is also possible to provide a magnetic recording layer or an adhesive layer on the rear side of the paper support. In addition, various known techniques employed in the field of the recording sheet manufacture may be applied to the present invention.

EXAMPLES

In the description that follows, Examples are shown to illustrate the present invention in further detail. However, the present invention is not limited to these Examples.

All parts and % in the Examples are by weight unless otherwise specified.

Heat-Sensitive Recording Paper

Example 1

(1) Preparation of Dispersion A

A composition was prepared by mixing 10 parts of 3-di(n-butyl)amino-6-methyl-7-anilinofluoran, 5 parts of a 10% aqueous solution of sulfone-modified polyvinyl alcohol (product name: GOHSERAN L-3266, manufactured by The Nippon Synthetic Chemical Industry Co.,Ltd.)and 25 parts of water. The thus-prepared composition was pulverized with a sand mill until an average particle diameter of 0.8 μm was attained, producing Dispersion A.

(2) Preparation of Dispersion B

A composition was prepared by mixing 10 parts of 4-hydroxy-4'-isopropoxydiphenylsulfone, 5 parts of a 10% aqueous solution of sulfone-modified polyvinyl alcohol (product name: GOHSERAN L-3266, manufactured by The Nippon Synthetic Chemical Industry Co.,Ltd.) and 25 parts of water. The thus-prepared composition was pulverized with a sand mill until an average particle diameter of 1.5 μm was attained, producing Dispersion B.

(3) Preparation of Dispersion C

A composition was prepared by mixing 10 parts of 1,2-di(3-methylphenoxy)ethane, 5 parts of a 10% aqueous solution of sulfone-modified polyvinyl alcohol (product name: GOHSERAN L-3266, manufactured by The Nippon Synthetic Chemical Industry Co.,Ltd.) and 25 parts of water. The thus-prepared composition was pulverized with a sand mill until an average particle diameter of 1.0 μm was attained, producing Dispersion C.

(4) Preparation of Coating Composition for Forming Heat-Sensitive Recording Layer A coating composition for forming heat-sensitive recording layer was prepared by mixing 50 parts of Dispersion A, 100 parts of Dispersion B, 100 parts of Dispersion C, 20 parts of precipitated calcium carbonate ("Brilliant 15" manufactured by Shiraishi Calcium Kaisha Ltd.), 20 parts of SBR latex ("L-1571" manufacture by Asahi Kasei Corporation), 20 parts of zinc stearate dispersion ("Hydrin Z-7-30" manufacture by Chukyo Yushi Co., Ltd.) and 30 parts of water and stirring the mixture.

(5) Preparation of Coating Composition for Forming Intermediate Layer

A coating composition for forming intermediate layer was prepared by mixing 100 parts of a 40% dispersion of hollow styrene particles having an average particle diameter of 1 μm and a hollowness (percentage of inner diameter to outer diameter) of 70%, 40 parts of a 10% aqueous solution of polyvinyl alcohol, 10 parts of styrene-butadiene latex having a solids content of 50%, 20 parts of calcined kaolin having an oil absorption of 110 ml/100 g, 5 parts of calcium carbonate having an average particle diameter of 1 μm and 50 parts of water, and stirring the mixture.

(6) Preparation of Security Element

A urethane resin adhesive (product name: "Super Flex 750" manufactured by DAI-ICHI KOGYO SEIYAKU CO., LTD.) was applied using a gravure roll coater to both sides of a polyethylene terephthalate (PET) film metallized with aluminum by vacuum deposition on both sides (thickness including vapor deposited metal layers: 12 μm) respectively in an amount of 3 g/m$^2$ on a dry weight basis. The applied adhesive was then dried. Subsequently, the film was slit with a microslitter into 3-mm width. The slit film was wound on a bobbin, preparing a security element.

(7) Preparation of Paper Support

In a cylinder paper machine equipped with three cylinder vats, a first wet web was made with a first cylinder, and a second wet web was made with a second cylinder. The security element obtained in (6) above was inserted at intervals of 10 cm between the first wet web and the second wet web which was still on the second cylinder and was about to leave the second cylinder. The resulting laminate was further combined with a third web, and the resulting combination wet web (water content: 50%) was dried with a Yankee dryer (surface temperature: about 70° C.) and 4 cylinder dryers (surface temperature: about 70 to 90° C.), producing a paper support having a water content of 5% and a thickness of 60 μm. In this paper support, the security element was embedded approximately at the center in the thickness direction of the paper support.

(8) Preparation of Heat-Sensitive Recording Paper

One side of the paper support prepared in item (7) above was coated with the coating composition for forming intermediate layer prepared in item (5) and the coating composition for forming recording layer prepared in item (4) successively in an amount of 8.0/m$^2$ and 6.0 g/m$^2$, respectively, on a dry weight basis. The coating compositions were dried, giving an intermediate layer and a heat-sensitive recording layer. The dried paper support was supercalendered, giving a heat-sensitive recording paper.

Example 2

A heat-sensitive recording paper was prepared following the procedure of Example 1 and using the paper support described below in place of the paper support used in the preparation of the heat-sensitive recording paper of Example 1.

(1) Preparation of Paper Support

A first wet web was made with a first cylinder in a cylinder paper machine equipped with three cylinder vats. A second wet web was prepared with a second cylinder. Between the first wet web and the second wet web which was still on the second cylinder and was about to leave the second cylinder, a gold silk thread (a silk thread metallized with gold; thickness (diameter) including the vapor deposited gold layer: 40 μm) was inserted at intervals of 10 cm.

The resulting laminate was combined with a third wet web prepared with a third cylinder and the combination wet web thus obtained (containing 50% of water) was dried with a Yankee dryer (surface temperature: about 70° C.) and 4 cylinder dryers (surface temperature: about 70 to 90° C.), giving a paper support having a water content of 5% and a thickness of 180 μm. In this paper support, the security element was embedded approximately at the center in the thickness direction of the paper support.

Example 3

The coating composition for forming protective layer described below was applied on the heat-sensitive recording layer of Example 1 in an amount of 2.5 g/m$^2$, on a dry weight basis. The applied coating composition was dried, forming a protective layer. Then the protective layer was supercalendered, giving a heat-sensitive recording paper.

(1) Preparation of Coating Composition for Forming Protective Layer

A composition was prepared by mixing 200 parts of a 12% aqueous solution of acetoacetyl-modified polyvinyl alcohol (product name: "GOHSEFIMER Z-200", manufactured by The Nippon Synthetic Chemical Industry Co., Ltd.), 60 parts of kaolin (product name: "Ultrawhite 90", manufactured by Engelhard Corporation), 30 parts of a 30% zinc stearate dispersion ("Hydrin Z-7-30", manufactured by Chukyo Yushi Co., Ltd.), 2 parts of polyamide epichlorohydrin resin cross-linking agent ("PA-801", manufactured by Japan PMC Corporation) and 210 parts of water. The composition was stirred, giving a coating composition for forming protective layer.

Comparative Example 1

A heat-sensitive recording paper was prepared in the same manner as in Example 1 with the exception of using a PET film metallized with aluminum by vacuum deposition on both sides (thickness including the vapor deposited metal layers: 30 μm) in place of the PET film metallized with aluminum by vacuum evaporation on both sides (thickness including the vapor deposited metal layers: 12 μm).

Test Example 1

The heat-sensitive recording papers prepared above were evaluated by the following methods. The results are shown in Table 1.

Corrugation

The heat-sensitive recording papers were rolled up (width: 40 cm, length: 50 m, core diameter: 5 cm). The rolls of the heat-sensitive recording papers were visually observed for their corrugation.

A: Almost no corrugation resulting from uneven thickness was observed in the roll.

B: Much corrugation resulting from uneven thickness was observed in the roll.

Quality of Recorded Image

The heat-sensitive recording materials prepared above were recorded at an applied energy of 0.2 mJ/dot by a thremosensitive printing tester (product name: TH-PMD, manufactured by Okura Denki Kabushiki Kaisha). The recorded portions, especially the recorded images around the boundaries of the security element portions and non-security element portions of the heat-sensitive recording materials were visually observed using a magnifier (x10).

A: Almost no missing dots was observed.

B: Some missing dots were observed.

C: Fairly many missing dots were observed.

TABLE 1

| | Corrugation | Quality of recorded image |
|---|---|---|
| Example 1 | A | A |
| Example 2 | A | B |
| Example 3 | A | B |
| Comparative Example 1 | B | C |

Ink Jet Recording Paper

Example 4

<Preparation of Silica Sol>

Synthetic amorphous silica (manufactured by Nippon Silica Industrial Co., Ltd., product name: Nipsil, HD-2, primary particle diameter: 11 nm) having an average particle diameter of 3 μm was pulverized and dispersed with a sand grinder, and further pulverized and dispersed with a high pressure homogenizer. These pulverizing and dispersing procedures with the sand grinder and the high pressure homogenizer were repeated until the average particle diameter of the secondary particles became 70 nm, giving a 10% dispersion.

The particle size of the dispersion was measured by the following method. TEM (transmission electron microscope, H-300, manufactured by Hitachi, Ltd.) was used for observation. The dispersion was diluted to 0.5%, and a drop of the dispersion was placed on a collodion membrane, air-dried and used for observation. The magnification of electron microscopic photographs was selected from 20,000, 50,000 and 100,000.

<Preparation of Coating Composition for Forming Ink-Receiving Layer>

To 100 parts (calculated as a solid) of the above silica sol were added 30 parts (calculated as a solid) of polyvinyl alcohol (manufactured by KURARAY CO.,LTD., product name: PVA-135H, polymerization degree: 3500, saponification degree: 99% or higher) and 15 parts (calculated as a solid) of diallyldimethylammonium chloride-acrylamide copolymer (manufactured by Nitto Boseki Co., Ltd., product name: PAS-J-81) as a cationic resin. Subsequently, the liquid mixture, thickened and agglomerated, was pulverized and dispersed with a sand grinder and high pressure homogenizer until the average particle diameter of the dispersion became 150 nm, giving a 10% coating composition for forming ink-receiving layer.

<Preparation of Ink Jet Recording Paper>

A coating composition for forming ink-receiving layer was applied to one side of the paper support obtained in the preparation of the paper support in Example 1 with a wire bar in an amount of 12 g/m$^2$ on a dry weight basis. The applied coating composition was dried to form an ink-receiving layer and then supercalendered, giving an ink jet recording paper.

Example 5

An ink jet recording paper was prepared in a manner similar to that of Example 4 except using the paper support obtained in the preparation of the paper support in Example 2 in place of the paper support used in the preparation of the ink jet recording paper in Example 4.

Example 6

<Preparation of Synthetic Resin Layer>

An ink jet recording paper was prepared following the procedure of Example 4. A molten polyethylene resin was extruded onto the rear side (the side of the paper support opposite of the ink-receiving layer) so as to give a resin layer having a thickness of 5 μm, giving a synthetic resin layer.

<Preparation of Ink Jet Recording Paper for Label>

A commercial silicone resin was applied on a glassine paper in an amount of 1.2 g/m$^2$. A commercial acrylic emulsion-based adhesive was applied to the silicon resin coating in an amount of 25 g/m$^2$ on a dry weight basis. The glassine paper and the above ink jet recording paper were bonded to each other with a press roll in such a manner that the adhesive-coated side of the glassine paper faced the synthetic resin-coated side of the ink jet recording paper, giving an ink jet recording paper for label.

Comparative Example 2

An ink jet recording paper was prepared following the procedure of Example 4 and using the paper support obtained in Comparative Example 1 in place of the paper support used for the ink jet recording paper of Example 4.

Test Example 2

The ink jet recording papers prepared above were evaluated by the following method. The results are shown in Table 2.

Corrugation

The ink jet recording papers obtained above were rolled up (width: 40 cm, length: 50 m, core diameter: 5 cm) respectively and visually observed for their corrugations.

A: Almost no corrugation resulting from uneven thickness was observed in the roll.

B: Strong corrugation resulting from uneven thickness was observed in the roll.

Quality of Recorded Image

The ink jet recording papers prepared above were used with an Epson ink-jet printer PM-800C to print the images ISO-400 ("standard color image data ISO/JIS-SCID", p 13, image name: Fruit basket, p 14, image name: Candle, published by Japanese Standards Association) in a glossy paper mode. Particularly, the recorded images around the place in which the security element was embedded were visually observed.

A: The outline of the security element was not visually observed in the recorded image as shadow image, and thus the recorded image had good quality.

B: The outline of the security element was visually observed in the recorded image as shadow image, and thus the recorded image had poor quality.

TABLE 2

| | Corrugation | Quality of recorded image |
|---|---|---|
| Example 4 | A | A |
| Example 5 | A | A |
| Example 6 | A | A |
| Comparative Example 2 | B | B |

Image Receiving Paper for Sublimation Transfer Recording

Example 7

(1) Preparation of Coating Composition for Forming Intermediate Layer

A composition was prepared by mixing 100 parts of a 40% dispersion of hollow styrene particles having an average particle diameter of 1 μm and hollowness (percentage of inner diameter to outer diameter) of 70%, 40 parts of a 10% aqueous solution of polyvinyl alcohol, 10 parts of styrene-butadiene latex having a solids content of 50%, 20 parts of calcined kaolin having an oil absorption of 110 ml/100 g, 5 parts of calcium carbonate having an average particle diameter of 1 μm and 50 parts of water. The composition was stirred, giving a coating composition for forming intermediate layer.

(2) Preparation of Coating Composition for Forming Sublimation Transfer Receiving Layer A composition was prepared by mixing 300 parts of toluene, 100 parts of polyester resin (trademark: Vylon 200, manufactured by Toyobo Co., Ltd.), 3 parts of silicone oil (trademark: KF393, manufactured by Shin-Etsu Chemical Co., Ltd.) and 5 parts of isocyanate (trademark: Takenate D-140N, manufactured by TAKEDA CHEMICAL INDUSTRIES, LTD.). The composition was stirred, giving a coating composition for forming sublimation transfer receiving layer.

(3) Preparation of Sublimation Transfer Receiving Paper

The coating composition for forming intermediate layer obtained in (1) above was applied on one side of the paper support prepared in Example 1 in an amount of 10 g/m$^2$ on a dry weight basis with a wire bar. The applied coating composition was dried to form an intermediate layer. The paper support was then supercalendered, giving an intermediate layer.

Subsequently, a low-density polyethylene (trademark: Mirason 11P, manufactured by Mitsui Petrochemical Industries, Ltd, density: 0.917 g/cm$^3$, melting point: 106° C.) was extruded in the form of a film having a thickness of 30 μm and bonded, for the purpose of lamination, to the intermediate layer and to the other side (back side) of the paper support to thereby form a resin layer. The coating composition for forming sublimation transfer receiving layer was applied to the resin layer on the intermediate layer side in an amount of 8 g/m$^2$ on a dry weight basis with a gravure coater. The applied coating composition was dried to form a sublimation transfer receiving layer, giving a sublimation transfer image receiving paper.

Example 8

A sublimation transfer receiving paper was prepared following the procedure of Example 7 and using the paper support prepared in Example 2 in place of the paper support used in the preparation of the sublimation transfer receiving paper in Example 7.

Comparative Example 3

A sublimation transfer receiving paper was prepared following the procedure of Example 7 and using the paper support prepared in Comparative Example 1 in place of the paper support used for the sublimation transfer receiving paper of Example 7.

Image Receiving Paper for Thermal Fusion Transfer Recording

Example 9

(1) Preparation of Coating Composition for Forming Intermediate Layer

A composition was prepared by mixing 100 parts of a 40% dispersion of hollow styrene particles having an average particle diameter of 1 μm and a hollowness (percentage of inner diameter to outer diameter) of 70%, 40 parts of a 10% aqueous solution of polyvinyl alcohol, 10 parts of styrene-butadiene latex having a solids content of 50%, 20 parts of calcined kaolin having an oil absorption of 110 ml/100 g, 5 parts of calcium carbonate having an average particle diameter of 1 μm and 50 parts of water. The composition was stirred, giving a coating composition for forming intermediate layer.

(2) Preparation of Coating Composition for Forming Thermal Fusion Transfer Receiving Layer A composition was prepared by mixing 30 parts of amorphous silica (trademark: Mizukasil P-527, manufactured by MIZUSAWA INDUSTRIAL CHEMICALS,LTD.), 55 parts of calcium carbonate (trademark: Brilliant-15, manufactured by Shiraishi Calcium Kaisha Ltd.) and 15 parts of styrene-butadiene latex (trademark: L-1571, manufactured by Asahi Kasei Corporation) having a solids content of 48%. The composition was stirred, giving a coating composition for forming thermal fusion transfer receiving layer.

(3) Preparation of Thermal Fusion Transfer Receiving Paper

The coating composition for forming intermediate layer and the coating composition for forming thermal fusion transfer receiving layer were successively applied with a wire bar to one side of the paper support prepared in Example 1 in amounts of 8 g/m$^2$ and 15 g/m$^2$, respectively, on a dry basis, followed by drying. The dried paper was supercalendered, giving a thermal fusion transfer receiving paper.

Example 10

A thermal fusion transfer receiving paper was prepared following the procedure of Example 9 and using the paper support prepared in Example 2 in place of the paper support used in the preparation of the thermal fusion transfer receiving paper of Example 9.

Comparative Example 4

A thermal fusion transfer receiving paper was prepared following the procedure of Example 9 and using the paper support prepared in Comparative Example 1 in place of the paper support used for the thermal fusion transfer receiving paper of Example 9.

Test Example 3

The sublimation transfer receiving paper and thermal fusion transfer receiving paper prepared in Examples 7 to 10 and Comparative Examples 3 and 4 were evaluated by the following methods. The results are shown in Table 3.

Corrugation

The respective sublimation transfer receiving paper and thermal fusion transfer receiving paper prepared above were rolled up (width: 40 cm, length: 50 m, core diameter: 5 cm). The rolls were visually observed for their corrugation.

A: Almost no corrugation resulting from uneven thickness was observed in the roll.

B: Strong corrugation resulting from uneven thickness was observed in the roll.

Quality of Recorded Image

Heat transfer sheets of yellow, magenta and cyan, each composed of a 6 μm-thick polyester film and a thermal transfer layer provided on the polyester film and containing a sublimable dye and a binder were prepared. The surface of the transfer receiving layer of the sublimation transfer receiving paper prepared above were brought into contact with the thermal transfer layers of the thermal transfer sheet of each color. A commercial thermal transfer video printer (trademark: VY-50, manufactured by Hitachi, Ltd.) was used for recording. The recorded portions, especially the recorded images around the boundary of the security element portion and non-security element portion were visually observed using a magnifier (x 10).

Heat transfer sheets of yellow, magenta and cyan, each composed of a 6 μm-thick polyester film and a thermal transfer layer provided on the polyester film and containing a coloring dye and a wax were prepared. The surface of the transfer receiving layer of the thermal fusion transfer receiving paper prepared above were brought into contact with the thermal transfer layer of the thermal transfer sheet of each color. A commercial thermal transfer video printer (trademark: VY-50, manufactured by Hitachi, Ltd.) was used for recording. The recorded portions, especially the recorded images around the boundary of the security element portion and non-security element portion were visually observed using a magnifier (x 10).

A: Almost no missing dot was observed.

B: Some missing dots were observed.

C: Fairly many missing dots were observed.

TABLE 3

| | Corrugation | Quality of recorded image |
|---|---|---|
| Example 7 | A | A |
| Example 8 | A | B |
| Example 9 | A | A |
| Example 10 | A | B |
| Comparative Example 3 | B | C |
| Comparative Example 4 | B | C |

Effects of the Invention

The recording paper of the present invention comprises a paper support having embedded therein a counterfeit prevention element, and still has little uneven thickness, and creates recorded images with excellent quality.

What is claimed is:

1. A recording paper comprising a paper support having a front surface and a rear surface opposite the front surface and a recording layer formed on the front surface of the paper support, the paper support having a ribbon-shaped security element embedded therein, the ribbon-shaped security element having a front surface facing the front surface of the paper support and a rear surface facing the rear surface of the paper support, and the recording paper being characterized in that:

the distance from the front surface of the paper support to the front surface of the security element is 1 to 7 times the thickness of the security element;

the distance from the rear surface of the paper support to the rear surface of the ribbon-shaped security element is 0.5 to 6 times the thickness of the security element;

the thickness of the paper support is 4 times to 10 times the thickness of the ribbon-shaped security element;

the thickness of the paper support is 40 to 250 μm;

the ribbon-shaped security element has a width of 0.3 mm to 20 mm and a thickness of 10 μm to 40 μm; and the recording layer is a heat-sensitive recording layer comprising an electron-donating compound, an electron-accepting compound and a binder.

2. The recording paper according to claim 1, in which the security element comprises a synthetic resin film and is a ribbon-shaped security element having a color different from that of the paper support.

3. The recording paper according to claim 1, in which the security element is a ribbon-shaped security element comprising a synthetic resin film provided with a vapor deposited metal layer on at least one side thereof, the paper support having a thickness of at least 3 times the total thickness of the vapor deposited metal layer and the synthetic resin film.

4. The recording paper according to claim 3, in which the vapor deposited metal layer is made of aluminum, copper, nickel, tin or zinc.

5. The recording paper according to claim 1, in which the security element is a ribbon-shaped security element comprising a synthetic resin film or a metallized synthetic resin film.

6. The recording paper according to claim 1, in which the security element has an adhesive layer comprising an adhesive as a main component on at least part of its surface.

7. The recording paper according to claim 6, in which the adhesive layer adheres to the paper support by contact of the adhesive layer and water when the security element having the adhesive layer is embedded within the paper support during paper making, or by the heat applied when the paper is dried after production, or by the pressure applied during supercalendering.

8. The recording paper according to claim 6, in which the adhesive is a polyester resin-based adhesive, a urethane resin-based adhesive, an acrylic resin-based adhesive or a vinyl acetate resin-based adhesive.

9. The recording paper according to claim 6, in which the adhesive layer further comprises at least one member selected from the group consisting of a fluorescent dye, a fluorescent pigment and a luminescent pigment.

10. The recording paper according to claim 6, in which the adhesive layer is prepared by uniformly dispersing an adhesive, and if desired at least one member selected from the group consisting of a fluorescent dye, a fluorescent pigment and a luminescent pigment, in water or an organic solvent serving as a medium to obtain a coating composition for forming an adhesive layer, applying the resulting coating composition to the ribbon-shaped security element in an amount of about 1 $g/m^2$ to about 10 $g/m^2$ on a dry weight basis, and drying the resulting coating.

11. The recording paper according to claim 1, in which a protective layer containing a binder having a film forming ability is formed on the heat-sensitive recording layer.

12. The recording paper according to claim 1, wherein an intermediate layer containing a pigment or hollow organic particles is provided between. the paper support and the recording layer.

13. A paper support for a recording paper, the paper support having a front surface and a rear surface opposite the front surface and having a ribbon-shaped security element embedded therein, the ribbon-shaped security element having a front surface facing the front surface of the paper support and a rear surface facing the rear surface of the paper support, and the recording paper being characterized in that:

the distance from the front surface of the paper support to the front surface of the security element is 1 to 7 times the thickness of the security element;

the distance from the rear surface of the paper support to the rear surface of the ribbon-shaped security element is 0.5 to 6 times the thickness of the security element;

the thickness of the paper support is 4 times to 10 times the thickness of the ribbon-shaped security element;

the thickness of the paper support is 40 to 250 $\mu$m; and the ribbon-shaped security element has a width of 0.3 mm to 20 mm and a thickness of 10 $\mu$m t0 40 $\mu$m.

14. The paper support according to claim 13, in which the security element comprises a synthetic resin film and is a ribbon-shaped security element having a color different from that of the paper support.

15. The paper support according to claim 13, in which the security element is a ribbon-shaped security element comprising a synthetic resin film provided with a vapor deposited metel layer on at least one side thereof, the paper support having a thickness of at least 3 times the total thickness of the vapor deposited metal layer and the synthetic resin film.

16. The paper support according to claim 15, in which the vapor deposited metal layer is made of aluminum, copper, nickel, tin or zinc.

17. The paper support according to claim 13, in which the security element is a ribbon-shaped security element comprising a synthetic resin film or a metallized synthetic resin film.

18. The paper support according to claim 13, in which the security element has an adhesive layer comprising an adhesive as a main component on at least part of its surface.

19. The paper support according to claim 18, in which the adhesive layer adheres to the paper support by contact of the adhesive layer and water when the security element having the adhesive layer is embedded within the paper support, or by the heat applied when the paper is dried after production, or by the pressure applied during supercalendering.

20. The paper support according to claim 18, in which the adhesive is a polyester resin-based adhesive, a urethane resin-based adhesive, an acrylic resin-based adhesive or a vinyl acetate resin-based adhesive.

21. The paper support according to claim 18, in which the adhesive layer further comprises at least one member selected from the group consisting of a fluorescent dye, a fluorescent pigment and a luminescent pigment.

22. The paper support according to claim 18, in which the adhesive layer is prepared by uniformly dispersing an adhesive, and if desired at least one member selected from the group consisting of a fluorescent dye, a fluorescent pigment and a luminescent pigment, in water or an organic solvent serving as a medium to obtain a coating composition for forming an adhesive layer, applying the resulting coating composition to the ribbon-shaped security element in an amount of about 1 $g/m^2$ to about 10 $g/m^2$ on a dry weight basis, and drying the resulting coating.

* * * * *